US005626160A

United States Patent [19]

Ko

[11] Patent Number: 5,626,160

[45] Date of Patent: May 6, 1997

[54] UMBRELLA HAVING MEANS FOR OPENING AND CLOSING THE SAME AUTOMATICALLY

[76] Inventor: Chin-Sung Ko, 7, Lane 30, Chung Hsiao Street, Changhua, Taiwan

[21] Appl. No.: 695,957

[22] Filed: Aug. 13, 1996

[51] Int. Cl.[6] ..... A45B 25/14

[52] U.S. Cl. ..... 135/22; 135/24

[58] Field of Search ..... 135/22, 24, 15.1, 135/20.3, 25.1, 28

[56] References Cited

U.S. PATENT DOCUMENTS

| | | | |
|---|---|---|---|
| 250,942 | 12/1881 | Mihiere | 135/24 |
| 680,661 | 8/1901 | Hunt | 135/24 |
| 4,424,824 | 1/1984 | Becher . | |
| 4,567,907 | 2/1986 | Dubinsky . | |
| 4,807,655 | 2/1989 | Robertson | 135/22 |
| 4,928,718 | 5/1990 | Apple | 135/22 |
| 5,144,969 | 9/1992 | Chan et al. | 135/22 |
| 5,174,319 | 12/1992 | Chou et al. | 135/24 X |
| 5,178,174 | 1/1993 | Wu | 135/24 X |
| 5,492,140 | 2/1996 | Lio et al. | 135/24 |

*Primary Examiner*—Lanna Mai
*Attorney, Agent, or Firm*—Beveridge, DeGrandi, Weilacher & Young LLP

[57] ABSTRACT

An umbrella includes a control device capable of actuating an upward movement of the umbrella opening spring located in the shaft so as to bring about the automatic opening of the umbrella. The elastic elements regulating the closing of the umbrella are compressed such that the lower rib holder is in the state of being pulled by two pull cords so as to keep the umbrella in its open position. When the control button of the control device is pressed for the second time, a control member regulating the closing of the umbrella is actuated to bring about the expansion of the umbrella closing elastic elements so as to cause the downward travel of the lower rib holder to result in the closing of the umbrella.

5 Claims, 5 Drawing Sheets

UMBRELLA HAVING MEANS FOR OPENING AND CLOSING THE SAME AUTOMATICALLY

FIELD OF THE INVENTION

The present invention relates generally to umbrella and more particularly to an umbrella provided with a press button by which the automatic opening and the automatic closing of the umbrella are controlled.

BACKGROUND OF THE INVENTION

The U.S. Pat. No. 4,567,907 discloses an umbrella provided with a pulley system for opening and closing the umbrella. In the process of opening the umbrella, two cord handles must be so located as to allow the locking pin to engage the insertion hole of the umbrella pole. Such a prior art umbrella as described above is defective in design in that both hands of a person opening the umbrella are busily occupied with the cord handles, and that the umbrella pole must be therefore located by a fixed object, such as a table to facilitate the opening of the umbrella. In addition, the cord handles are something of a nuisance when the umbrella is used in a stormy weather in which the cord handles are fluttered about by the wind.

There is another U.S. Pat. No. 4,424,824 which discloses an umbrella provided with a rope to control the opening and the closing of the umbrella. The use of such a prior art umberella as disclosed in the above-mentioned U.S. patent is inconvenient at best.

SUMMARY OF THE INVENTION primary objective of the present invention is to provide an umbrella capable of overcoming the drawbacks of the prior art umbrella disclosed respectively in the two U.S. patents referred to above.

The umbrella of the present invention comprises a shaft, a rib frame, a handle, a control device, an umbrella opening spring, and a plurality of umbrella closing, elements. The automatic opening of the umbrella is brought about by the control device capable of actuating the upward movement of the umbrella opening spring inside the shaft. In the meantime, the elastic elements regulating the closing of the umbrella are compressed such that the lower rib holder is in the state of being pulled by two pull cords so as to keep the umbrella in its open position. When the control button of the control device is pressed for the second time, a control member regulating the closing of the umbrella is actuated to bring about the expansion of the umbrella closing elastic elements so as to cause the downward travel of the lower rib holder, thereby resulting in the closing of the umbrella.

The foregoing features and advantages of the present invention will be more readily understood upon a thoughtful deliberation of the following detailed description of an embodiment of the present invention in conjunction with the accompanying drawings.

DETAILED DESCRIPTION OF THE EMBODIMENT

Figure 1:
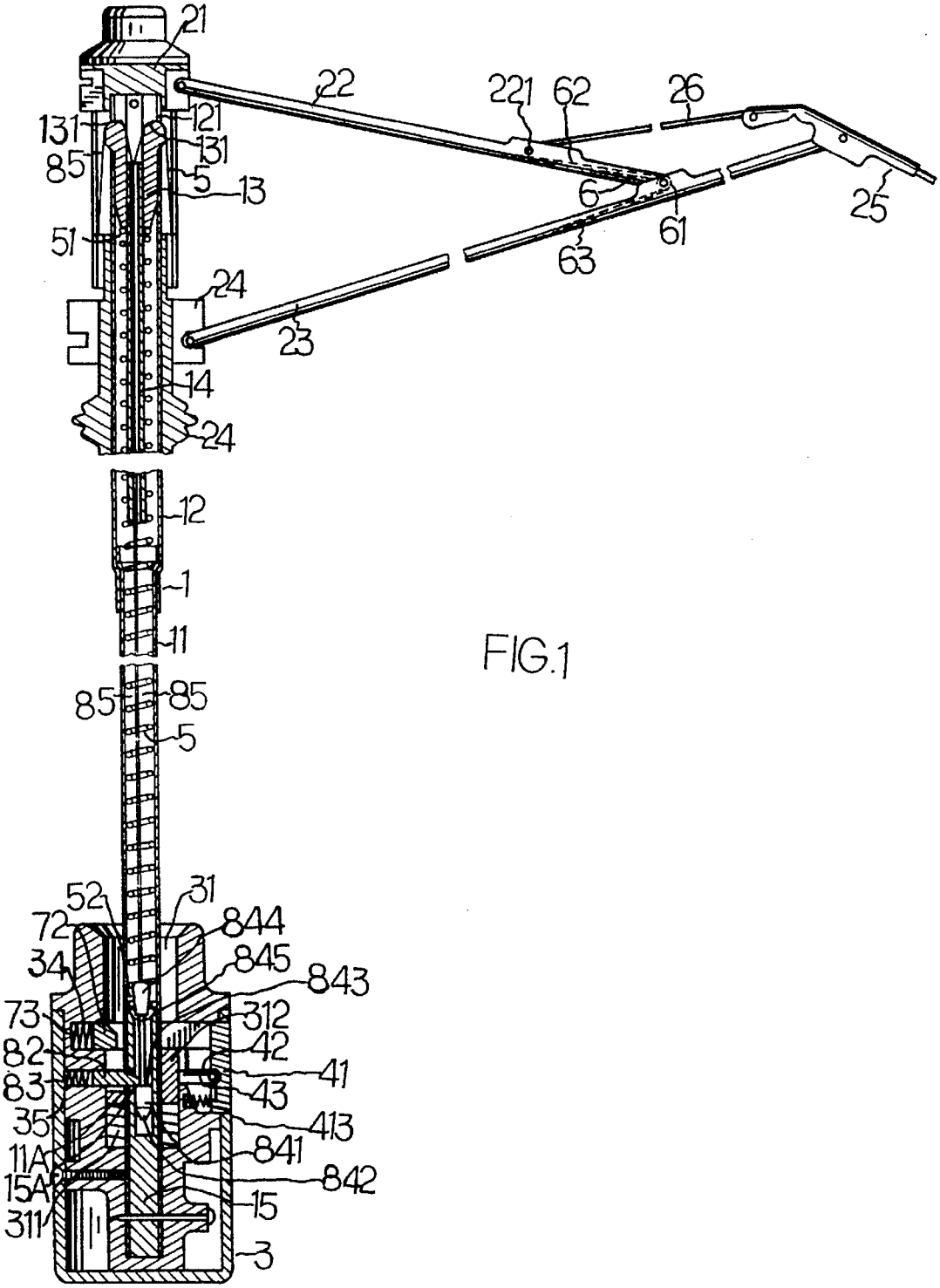
FIG. 1 shows a schematic view of the present invention in its open position.

As shown in all drawings provided herewith, an umbrella embodied in the present invention is composed of a shaft, a rib frame 2, a handle 3, a control device 4, an umbrella opening elastic element 5, a plurality of umbrella closing elastic element 6, an umbrella opening control member 7, and an umbrella closing control member 8.

The shaft 1 comprises an inner tube 11 which is fastened securely at the lower end thereof in a fastening hole 31 of the handle 3. The fastening hole 31 of the handle 3 is provided therein with a spring 311 and a cushioning sleeve 312 which is provided in the periphery thereof with a slot 3121 extending in the direction of the longitudinal axis of the cushioning sleeve 312. The slot 3121 is provided with two protuberances 3122 opposite in location to each other. The shaft 1 further comprises an outer tube 12 which is slidably fitted over the tuner tube 11. The outer tube 12 is provided with a hole 121 in which a hollow inner block 13 is received. The inner block 13 is provided with two symmetrical recesses 131. An upper sleeve 14 is inserted into the hollow inner block such that one end of the upper sleeve 14 is located over the tuner tube 11, and that the upper sleeve 14 is fitted into a tension spring 5. A lower sleeve 15 is fastened with the lower end of the inner tube 11 and is provided with a tapered opening 151 for guiding a head retaining device. The inner tube 11 and the lower sleeve 15 are provided respectively with a cross through hole 11A and a cross through hole 15A.

The rib frame 2 comprises an upper rib holder 21 which is fastened securely with the top end of the outer tube 12. The rib frame 2 further comprises a plurality of upper ribs 22 which are fastened pivotally at one end thereof with the upper rib holder 21. A plurality of lower ribs 23 are fastened pivotally and respectively at one end thereof with a lower rib holder 24 which is slidably fitted over the outer tube 11 of the shaft 1. The lower rib holder 24 has a sleeve 241 which is provided with a hole 242. A plurality of outer ribs 25 are fastened pivotally and respectively at one end thereof with a connection rib 26 which is in turn fastened at one end thereof with the upper rib 22. The upper ribs 22 are fastened pivotally and respectively with the midsegments of the lower ribs 23.

Each of the umbrella closing elastic elements 6 is provided with a torsion portion 61 which is fastened with a pivot point at which the upper rib 22 and the lower rib 23 are pivoted. The umbrella closing elastic element 6 has an upper leg 62, which is expanded to urge a pivot 221 of the upper rib 22 and the connection rib 26 at such time when the umbrella is closed. In the meantime a lower leg 63 of the elastic element 6 urges the lower rib 23. The inner block 13 is urged by a top end 51 of the umbrella opening tension spring 5 while the bottom end 52 of the tension spring 5 is urged by the lower sleeve 31.

The control device 4 comprises a control button 41, which is slidably engaged with a button slot 33 of the handle 3 such that the shoulders 411 of the button 41 are confined by the outer sleeve 32. The button 41 is provided with a through hole 412. The control device 4 further comprises an arresting piece 42, which has a shaft rod 421 provided with a protuberance 422, two arms 423, an axial hole 424, and a slot 425 for receiving a torsion spring 43. The arresting piece 42 is located by a pin 44 passing through the through hole 412 of the control button 41 and the axial hole 424 of the shall rod 421 of the arresting piece 42 such that the arresting piece 42 is urged by the torsion spring 43. In the meantime, the control button 41 is urged by a spring 413.

The umbrella opening control member 7 comprises two arms 71, one retaining piece 72, and a spring 73. The retaining piece 72 is located between the two arms 71 and is provided at one end thereof with an inclined surface 721. The spring 73 is received in an upper slot 34 of the handle 3 such that the arms 71 are urged by the spring 73 so as to cause the retaining piece 72 to engage the hole 242 of the sleeve 241 of the lower rib holder 24.

The umbrella closing control member 8 comprises two protruded pieces 81, one arresting piece 82 located between the two protruded pieces 81, a spring 83, a retaining piece 84, and two pull cords 85. The spring 83 is received in a lower slot 35 of the handle 3 such that the spring 83 is capable of driving the arresting piece 82 to engage the slot 3121 of the cushioning sleeve 312, the cross through holes 11A and 15A of the inner tube 11 and the lower sleeve 15. The retaining piece 84 comprises a head 841, a tapered bottom 842, a shoulder 843, a pivoting portion 844, and a neck 845. The two pull cords 85 are fastened pivotally and respectively at one end thereof with the pivoting portion 844 of the retaining piece 84. Another ends of the two pull cords 85 are received in the center of the shaft 1 such that they are put through the upper sleeve 14 and the inner block 13 before they are fastened with the lower rib holder 24.

Figure 6:
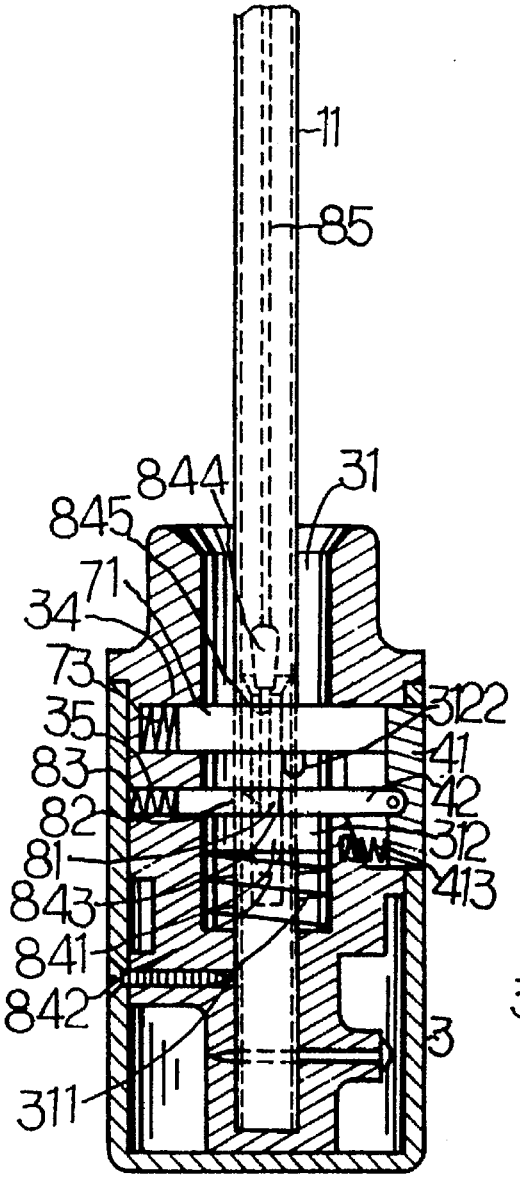
FIG. 6 is another schematic view showing the opening of the umbrella of the present invention.

In operation, the control button 41 is pressed first to push the arms 71 of the umbrella opening control member 7 so as to bring about a rearward movement of the control member 7. As a result, the retaining piece 72 of the control member 7 is caused to disengage the hole 242 of the lower sleeve 241 of the lower rib holder 24. In the meantime, the outer tube 12 is urged upwards by the tension spring 5 such that the rib frame 2 is opened up, as shown in FIG. 1. The upper rib holder 21 is caused to move upwards along the shaft 1 so as to cause the pull cords 85 of the umbrella closing control member 8 to remain in the state of being pulled. The upper leg 62 and the lower leg 63 of the umbrella closing elastic member 6 are compressed by the upper rib 22 and the lower rib 23. As a result, the umbrella is locked in its open position, in view of the fact that the retaining piece 84 is arrested securely, as shown in FIG. 6. In other words, the umbrella closing elastic members 6 remain in the state of being locked.

Figure 7:
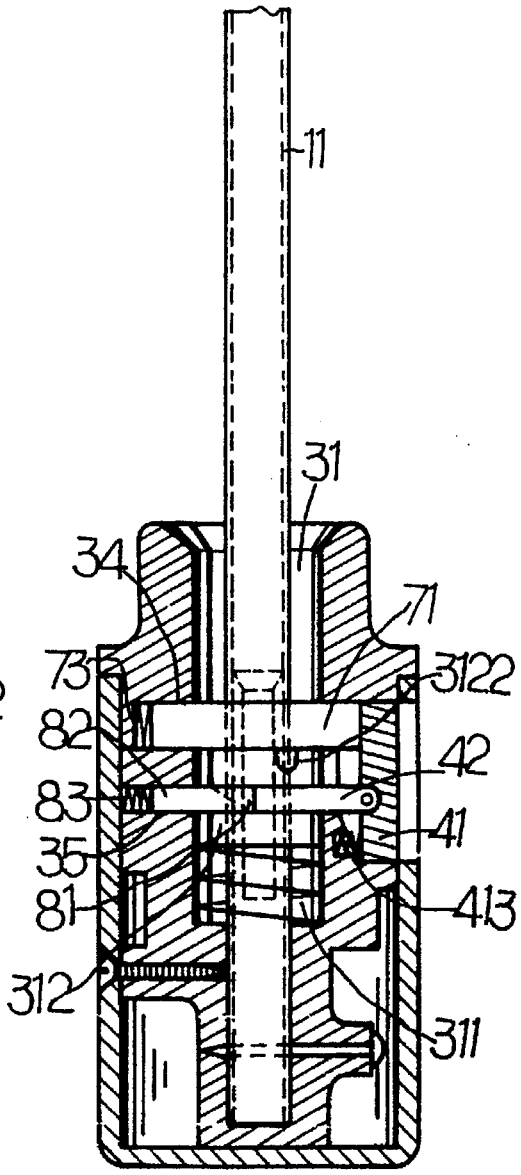
FIG. 7 is a schematic view showing the closing of the umbrella of the present invention.

When the control button 41 is pressed for the second time, the arresting piece 42 of the control button 41 is pressed by the protuberance 3122 of the cushioning sleeve 312 to warp downwards. The sleeve 241 of the lower rib holder 24 is moved upwards so as to cause the spring 311 to expand to lbrce the cushioning sleeve 312 to displace upwards until the cushioning sleeve 312 is stopped by the umbrella opening control member 7. As a result, the arresting piece 42 is located horizontally. If the control button 41 is Dressed, the arresting piece 42 is moved tbrward, as shown in FIG. 7, such that the protruded pieces 81 are urged by the arms 423 of the arresting piece 42, and that the arresting piece 82 of the umbrella closing control member 8 is displaced to bring about the release of the pull cords 85 by the retaining piece 84. The lower rib holder 24 is forced by the expansion force of the elastic elements 6 to move downwards along the shaft 1. thereby causing the rib frame 2 to fold in the direction toward the shaft 1.

Figure 2:
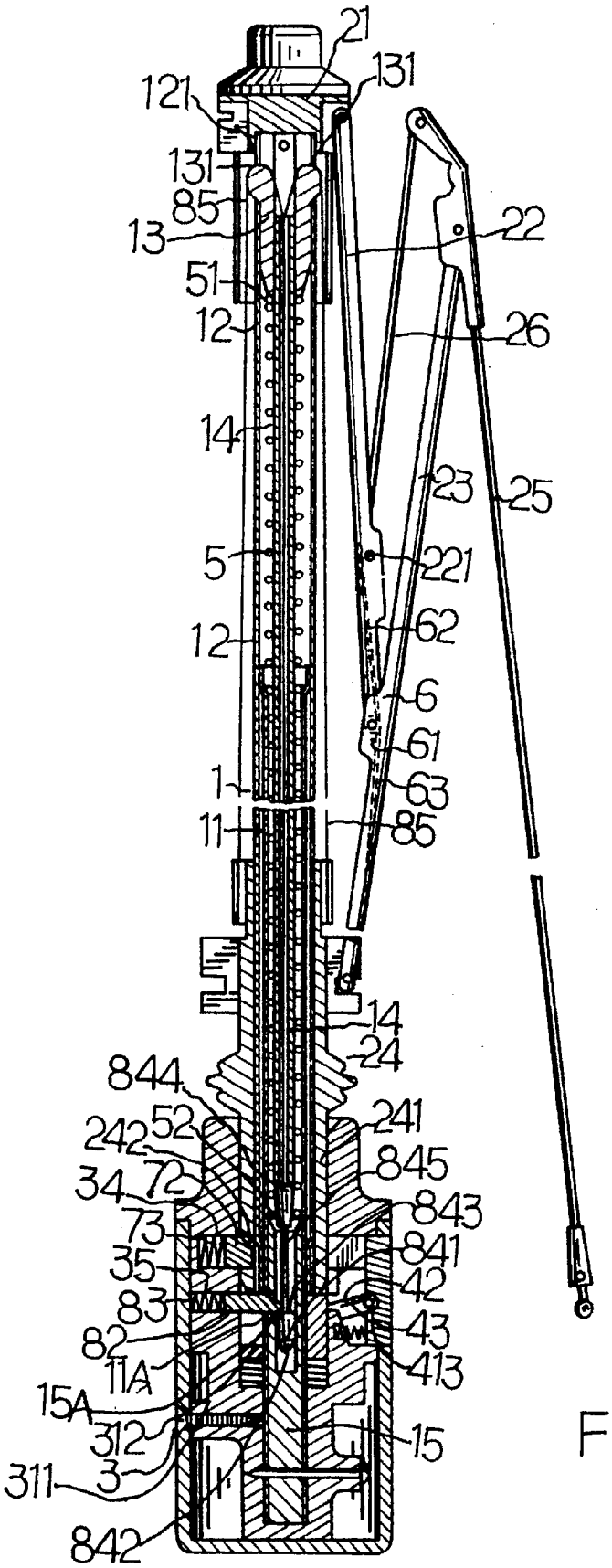
FIG. 2 shows a schematic view of the present invention in its closed position.
Figure 3:
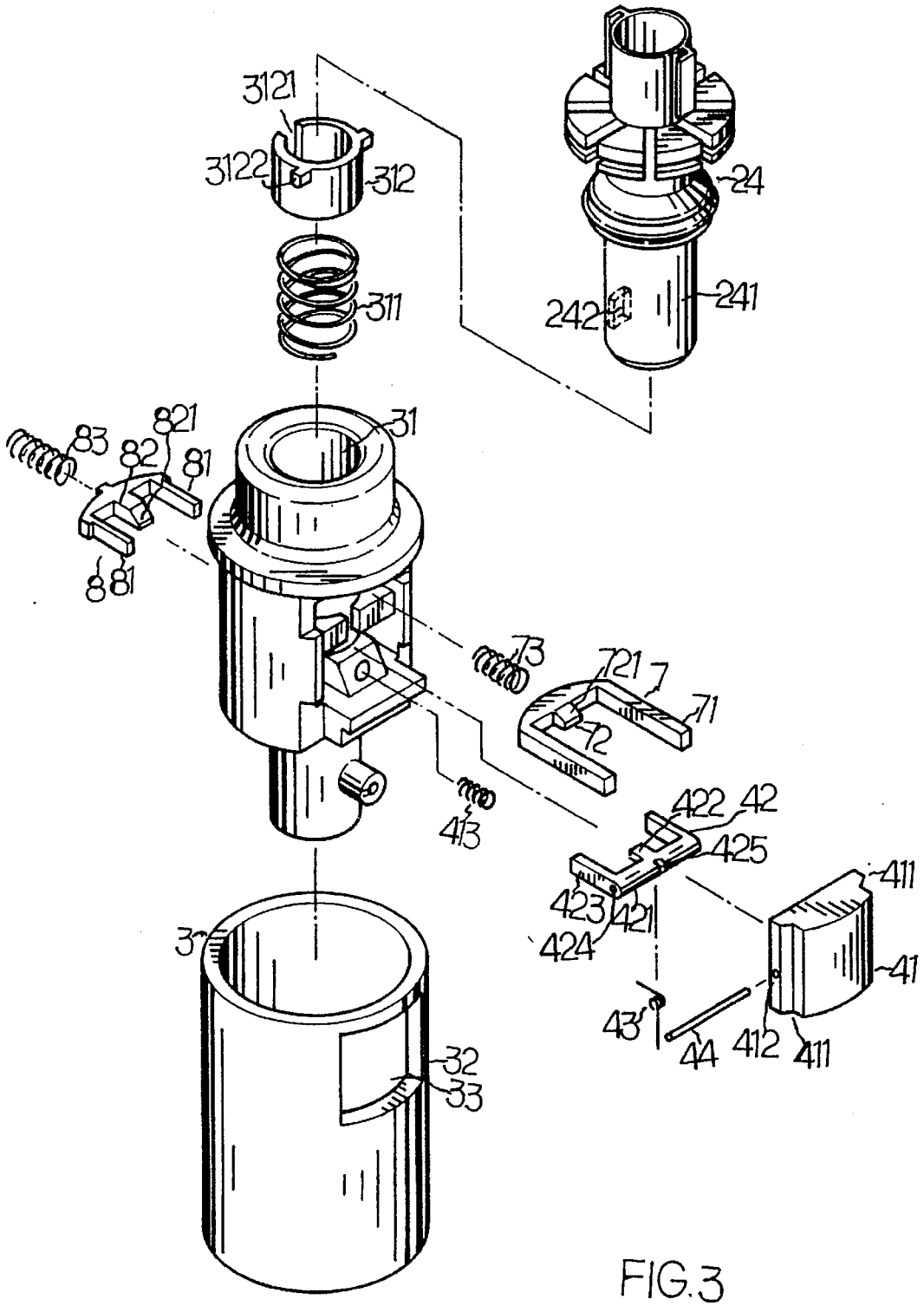
FIG. 3 shows an exploded view of the control device of the present invention.
Figure 5:
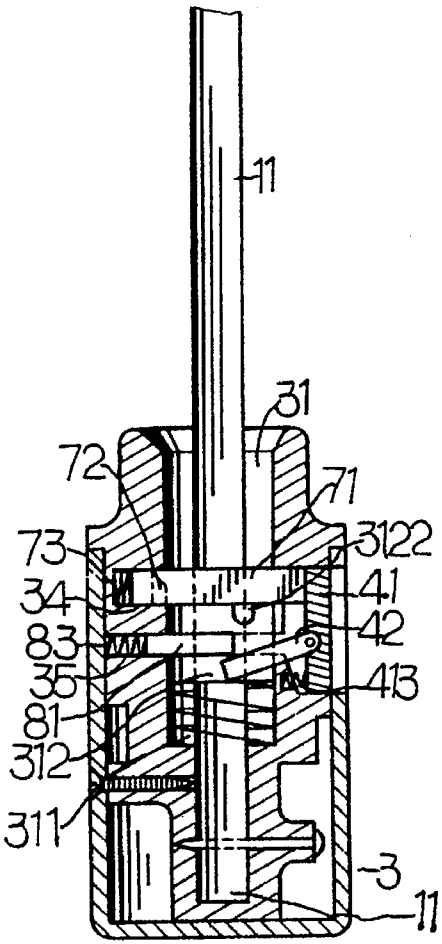
FIG. 5 is a schematic view showing the opening of the umbrella of the present invention.
Figure 4:
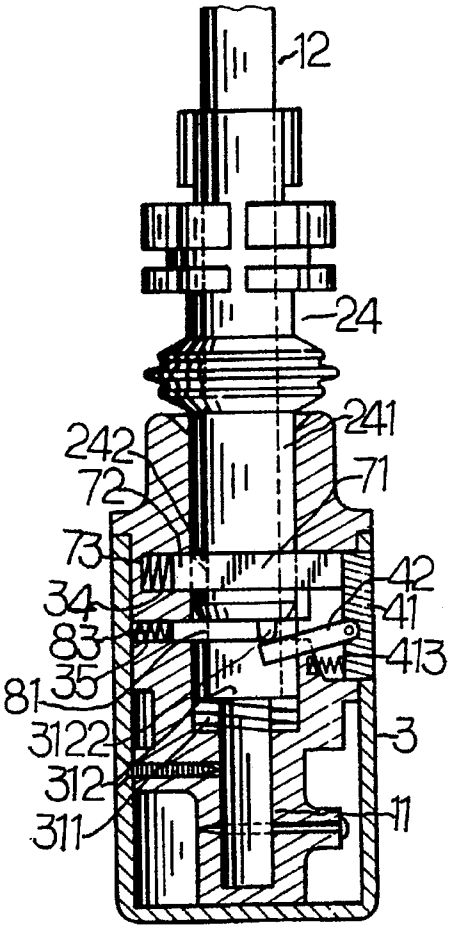
FIG. 4 shows a schematic view of the present invention in the state of being closed.

As illustrated in FIGS. 2 and 4, the elasticity of the tension spring 5 can be reset. As the handle 3 is pressed, the sleeve 241 of the lower rib holder 24 is forced into the fastening hole 31 so as to exert a pressure on the retaining piece 72 of the umbrella opening control member 7. The retaining piece 72 is urged by the spring 73 to engage the hole 242 of the sleeve 241 of the lower rib holder 24. In the meantime, the spring 311 is compressed slightly so as to cause the protuberance 3122 of the cushioning sleeve 312 to force the arresting piece 42 of the control button 41 to curve downwards. As a result, both inner tube 11 and the outer tube 12 of the shaft 1 are ready for operation. When the umbrella is closed, the upper sleeve 14 pushes the retaining piece 84 downwards so as to cause the head 841 to enter the lower sleeve 15. In the meantime, the arresting piece 82 of the umbrella closing control member 8 is under pressure. The spring 83 of the umbrella closing control member 8 urges the shoulder 843 to be located under the arresting piece 82. The umbrella is ready for another round of operation.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claim.

What is claimed is:

1. An umbrella comprising:

a handle provided at an upper end thereof with a fastening hole extending in the direction of a longitudinal axis thereof, said fastening hole provided thereto with a spring and a cushioning sleeve which is provided in a periphery thereof with a slot having two protuberances opposite to each other, said handle further provided with an upper slot, a lower slot, and button slot;

a shaft comprising an inner tube, an upper sleeve, an outer tube, and a lower sleeve, said inner tube having one end secured to said fastening hole of said having one end secured to said fastening hole of said handle such that said inner tube is fitted slideably over with said outer tube, said outer tube having a hole in which a hollow inner block is received such that said upper sleeve is inserted into said hollow inner block, said lower sleeve fastened with a lower end of said inner tube and provided with a tapered opening and a cross through hole, said inner tube further provided with a cross through hole;

a rib frame comprising an upper rib holder secured to one end of said outer tube of said shaft, a plurality of upper ribs fastened pivotally and respectively at one end thereof with said upper rib holder, a lower rib holder slideably fitted over said outer tube of said shaft, a plurality of lower ribs fastened pivotally and respectively at one end thereof with said lower rib holder, and a plurality of outer ribs fastened pivotally and respectively at one end thereof with a connection rib which is in turn fastened at one end thereof with one of said upper ribs;

a plurality of umbrella closing elastic elements provided respectively with a torsion portion fastened with a pivot point at which one of said upper ribs and one of said lower ribs are pivoted, said elastic elements further provided respectively with an upper leg and a lower leg;

a control device comprising a control button, an arresting piece, and a torsion spring, with said control button being slideably engaged with said button slot of said handle and provided with a through hole, said arresting piece having a shaft rod provided with a protuberance, two arms, an axial hole, and a slot for receiving said torsion spring;

an umbrella opening control member comprising two arms, one retaining piece, and a spring, said retaining piece located between said two arms and provided with an inclined surface, said spring being received in said upper slot of said handle such that said spring is capable of urging said arms to cause said retaining piece to engage said lower rib holder; and an umbrella closing control member comprising two protruded pieces, one arresting piece located between said two protruded pieces, a biasing means, a retaining piece, and two pull cords, said biasing means being received in said lower slot of said handle such that said biasing means of capable of driving said arresting piece to engage said slot of said cushioning sleeve of said handle, said cross through hole of said inner tube and said cross through hole of said lower sleeve fastened with said inner tube of said shaft, said two pull cords being fastened respectively at one end thereof with said retaining piece and at another end thereof with said lower rib holder.

2. The umbrella as defined in claim 1, wherein said lower rib holder has a sleeve provided with a hole engageable with said retaining piece of said umbrella opening control member.

3. The umbrella as defined in claim 1, wherein said upper sleeve of said inner block of said outer tube of said shaft is provided with a tension spring fitted thereover for urging said outer tube to move upwards such that said rib frame is opened up.

4. The umbrella as defined in claim 1, wherein said arresting piece of said control device is located by a pin passing through said through hole of said control button and an axial hole of said arresting piece such that said arresting piece is urged by said torsion spring.

5. The umbrella as defined in claim 1, wherein said retaining piece of said umbrella closing control member comprises a head, a tapered bottom, a shoulder, a pivoting portion, and a neck; wherein said two pull cords are fastened respectively at one end thereof with said pivoting portion of said retaining piece of said umbrella closing control member; wherein said lower sleeve of said inner tube of said shaft is engageable with said head of said retaining piece of said umbrella closing control member; and wherein said biasing means of said umbrella closing control member is capable of urging said shoulder of said retaining piece of said umbrella closing control member to locate under said arresting piece of said umbrella closing control member.

* * * * *

US005626160B1

REEXAMINATION CERTIFICATE (3705th)

United States Patent [19] [11] B1 5,626,160

Ko [45] Certificate Issued Jan. 12, 1999

[54] UMBRELLA HAVING MEANS FOR OPENING AND CLOSING THE SAME AUTOMATICALLY

[76] Inventor: Chin-Sung Ko, 7, Lane 30, Chung Hsiao Street, Changhua, Taiwan

Reexamination Request:
No. 90/004,827, Nov. 5, 1997

Reexamination Certificate for:

| | |
|---|---|
| Patent No.: | **5,626,160** |
| Issued: | **May 6, 1997** |
| Appl. No.: | **695,957** |
| Filed: | **Aug. 13, 1996** |

[51] Int. Cl.[6] ..... A45B 25/14
[52] U.S. Cl. ..... 135/22; 135/24
[58] Field of Search ..... 135/22, 24, 20.3, 135/25.1, 28, 15.1

[56] References Cited

U.S. PATENT DOCUMENTS 4,941,494 7/1990 Wu .
5,267,583 12/1993 Wu .
5,441,065 8/1995 Lin et al. .
5,505,222 4/1996 Lin et al. .
5,617,889 4/1997 Wu .

*Primary Examiner*—Lanna Mai

[57] ABSTRACT

An umbrella includes a control device capable of actuating an upward movement of the umbrella opening spring located in the shaft so as to bring about the automatic opening of the umbrella. The elastic elements regulating the closing of the umbrella are compressed such that the lower rib holder is in the state of being pulled by two pull cords so as to keep the umbrella in its open position. When the control button of the control device is pressed for the second time, a control member regulating the closing of the umbrella is actuated to bring about the expansion of the umbrella closing elastic elements as as to cause the downward travel of the lower rib holder to result in the closing of the umbrella.

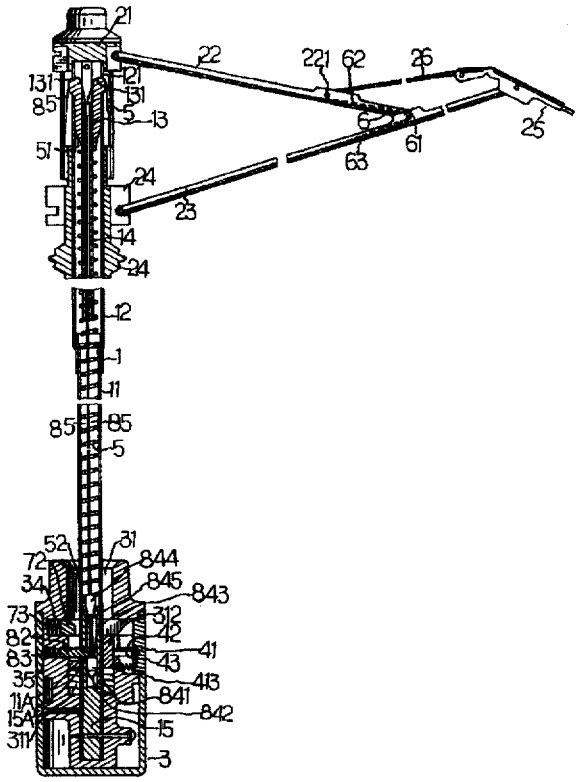

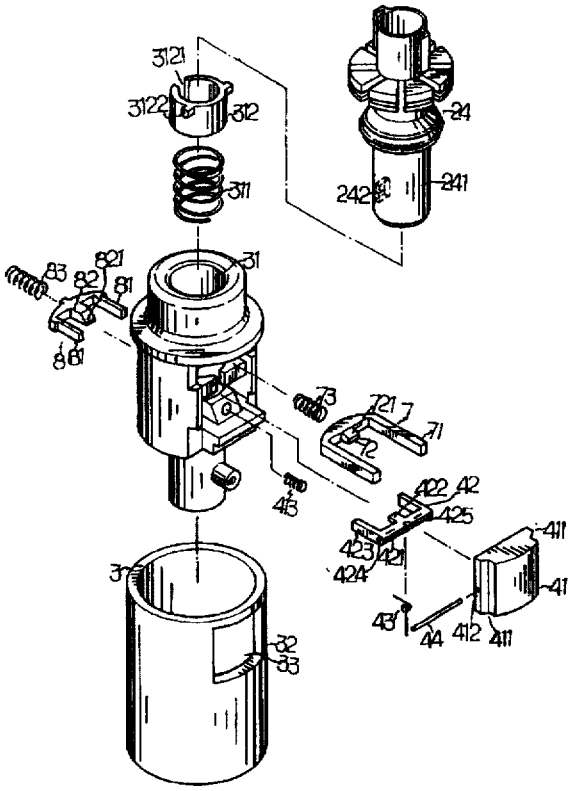

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–5 is confirmed.

New claim 6 is added and determined to be patentable.

*6. The umbrella as defined in claim 1, wherein:*

*said two protuberances of said cushioning sleeve engage and bias said arresting piece of said control device downward.*

* * * * *